US006726026B1

(12) United States Patent
Wilkerson

(10) Patent No.: US 6,726,026 B1
(45) Date of Patent: Apr. 27, 2004

(54) SEED HUSK SEPARATOR

(76) Inventor: Lawrence Edwin Wilkerson, 775 E. Blithedale Ave. #3933, Mill Valley, CA (US) 94941

( * ) Notice: Subject to any disclaimer, the term of this patent is extended or adjusted under 35 U.S.C. 154(b) by 92 days.

(21) Appl. No.: 09/934,133

(22) Filed: Aug. 20, 2001

(51) Int. Cl.[7] ..... B07B 4/00

(52) U.S. Cl. ..... 209/477; 209/479; 209/480; 209/493

(58) Field of Search ..... 209/479, 480, 209/644, 932, 20, 465, 477, 493; 494/43, 56, 58, 59, 63, 67

(56) References Cited

U.S. PATENT DOCUMENTS 2,741,368 A * 4/1956 Satake ..... 209/479
3,616,903 A * 11/1971 Cicero ..... 209/139.1
6,439,394 B1 * 8/2002 Eiderman et al. ..... 209/479

FOREIGN PATENT DOCUMENTS

SU 1200999 * 12/1985 ..... 209/479

* cited by examiner

*Primary Examiner*—Donald P. Walsh
*Assistant Examiner*—Joseph Rodriguez
(74) *Attorney, Agent, or Firm*—Risto A. Rinne, Jr.

(57) ABSTRACT

An apparatus and method for the separation of husks and other chaff material apart from bird seed includes a smaller diameter inner container that is placed inside of a larger diameter outer container. A plurality of feet elevate the inner container above a floor of the outer container. A lid is used to cover the outer container and also the inner container. A housing is attached to the inside center of the lid and it includes a motor disposed distally from the lid with a fan blade attached thereto to displace air. A plurality of vanes are attached to the housing from which they extend until they contact the inside surface of the inner container. The vanes prevent a cyclonic air current pattern from occurring and so help to displace the husks apart from the seed. An offset mass introduces vibration which tends to raise more of the husks to the surface where they are displaced out from the inner container. The husks pass around the outside edge of the inner container and settle in a pile underneath the inner container on the floor of the outer container thereby leaving predominantly good clean seed in the inner container once again ready for use.

12 Claims, 2 Drawing Sheets

SEED HUSK SEPARATOR

BACKGROUND OF THE INVENTION

1. Field of the Invention

The present invention, in general relates to bird seed and, more particularly, to devices that separate the husks apart from the seed of partially eaten birdseed.

It is common for bird owners to feed their birds various types of seeds. The seeds are placed in a dish and the dish is placed in a bird cage. As the birds eat the seeds that are on the surface of the dish they leave behind the husks which accumulate atop the remaining good seeds. Eventually, the remaining seeds are buried underneath a layer of husks. As the husks accumulate, the seeds become increasingly inaccessible to the birds.

As is common, the bird owner then periodically removes the dish with some quantity of good seeds remaining at the bottom and the husks disposed primarily above the good seeds (but with some husks mixed in amongst the good seeds) and, more often than not, discards everything into the trash.

The reason that even the good seeds are discarded is because it is not easy to separate the husks apart from the seeds. Blowing may help but as all too many bird owners know, there is a substantial danger that a husk can be blown out of the dish and strike an eye of the bird owner. The husks are hard and sharp and may at best, irritate the eye or worse yet, severely cut the eye. Clearly, this is undesirable. Furthermore, the husks may be treated with anti-fungal ingredients that can irritate the eyes or body.

The problem of separating the husks apart from the seeds is further compounded by the fact that not all of the husks are on top of the seeds. As the bird rummages for food, some of the husks tend to work their way down into the seeds.

Simply blowing the husks will only remove a portion of the husks that are on the surface. The husks that are dispersed amongst the seeds are not removed by any amount of blowing. Consequently, the bird owner is unable to determine how much of the remaining bulk in the seed dish is good seed and how much of it is husk.

It is important for bird owners to remove almost all of the husks to ensure that what remains are edible seeds. If a bird owner were merely to blow the surface husks off, difficult as that may be, and then replace the dish possibly "topping off" the dish, the bird owner would not know if the dish contained an adequate supply of good seed.

If an insufficient quantity of good seed remained in the dish and if this were left for an extended period of time, this would threaten the health, perhaps even the survival, of the bird (or birds) that are dependent upon the supply of seed.

Furthermore, bird owners find that blowing on the husks and seeds creates a substantial mess. Consequently, bird owners soon realize that if they are to attempt blowing they must do so outside. It takes additional time to remove the seed dish, carry it outside, blow on the seeds to remove as many of the husks as possible, then bring the dish back inside, top it off, and put it back into the cage.

Consequently, most bird owners do not fuss with the husks and the seeds but rather dump all of the contents into the trash. This practice is clearly wasteful of the good remaining seed.

These aforementioned problems apply to all types of birds that consume seeds, for example, canaries, finches, parakeets, conjures, parrots, and the like.

Attempts to mechanically separate the husks (or chaff) apart from the seeds that rely upon moving air fail to address the aforementioned problems. Simply creating a vortex of circulating air is ineffective at removing the husks from the top and is useless at removing the husks that are disposed amongst the seeds.

Accordingly, there exists today a need for a fast, clean, easy, and economical way to thoroughly separate the husks apart from the remaining good seeds.

Clearly, such an apparatus would be a useful and desirable device.

2. Description of Prior Art

Husk separators are, in general, known. For example, the following patents describe various types of these devices:

U.S. Pat. No. 6,044,796 to Ireland, Apr. 4, 2000;

U.S. Pat. No. 4,979,622 to Chiang, Dec. 25, 1990; and

U.S. Pat. No. 3,616,903 to Cicero, Nov. 2, 1971.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a seed husk separator that can be used indoors.

It is also an important object of the invention to provide a seed husk separator that is effective at separating husks apart from seeds.

Another object of the invention is to provide a seed husk separator that is inexpensive to manufacture.

Still another object of the invention is to provide a seed husk separator that creates an uneven air flow pattern which is effective at removing husks apart from seed.

Still yet another object of the invention is to provide a seed husk separator that can be battery powered.

Yet another important object of the invention is to provide a seed husk separator that creates an uneven flow of air to optimally agitate and move the husks.

Still yet another important object of the invention is to provide a seed husk separator that includes vibration to settle the good seed to the bottom while using moving air to move the husks that rise to the top apart from the good seed.

Still yet one other important object of the invention is to provide a seed husk separator that can be formed of a pliable type of plastic, similar to that used in TUPPERWARE™ types of products.

Briefly, a seed husk separator that is constructed in accordance with the principles of the present invention has an outer container that houses a smaller inner container. The inner container has, generally, a "W-shaped" cross-section and it includes a plurality of feet so that it is disposed above the floor of the outer container when placed therein. A vane assembly is preferably attached to a lid which is used as cover over the outer container. The vane assembly includes a plurality of vanes that form arcuate planar surfaces that extend from an inner housing and which contact the inside surface of the inner container when the lid is placed atop the outer container. An electric motor drives a fan which blows air onto the center of the inner container. The motor is disposed in the housing intermediate one end of each of the vanes. The motor includes an offset mass which introduces vibration to the vanes that is coupled to the inner container. During use, seeds including husks are deposited into the inner container which is placed inside the outer container and the lid is attached. A switch is used to actuate the motor for approximately one minute during which time an uneven air flow pattern is directed toward the seeds and the husks that effectively displaces the husks from the seeds. The husks migrate out of inner container and are displaced beyond the edges of the inner container. The husks accumulate and settle underneath the inner container. The vibration causes the majority of the remaining husks, dust, and other light residue to rise to the surface of the seeds where they too are displaced so that primarily, only good seed remains in the inner container. The motor is stopped, the lid is removed, and the good seed is once again used as high quality bird seed.

DETAILED DESCRIPTION OF THE INVENTION

Figure 1:
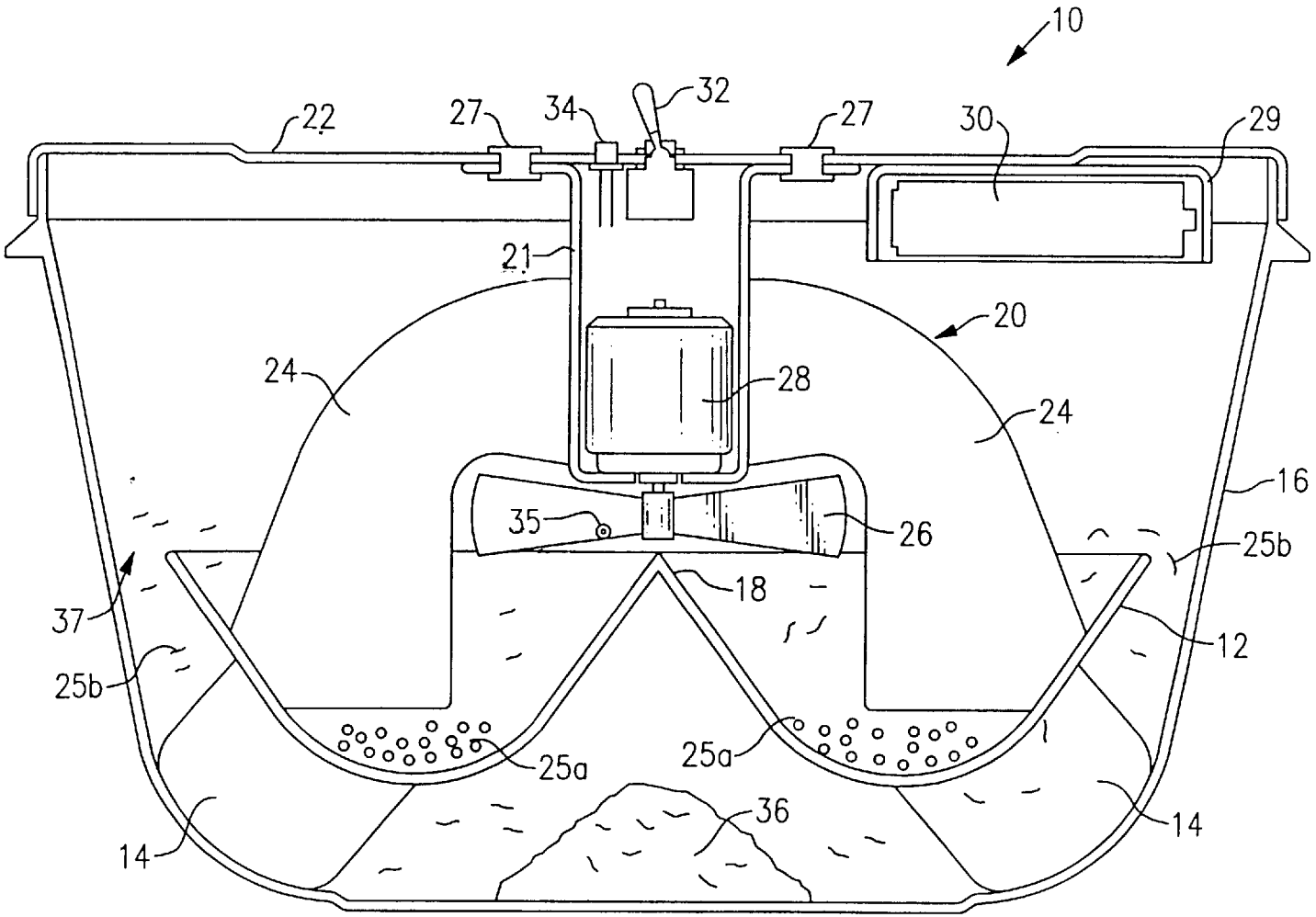
FIG. 1 is a cross-sectional view of a seed husk separator.
Figure 2:
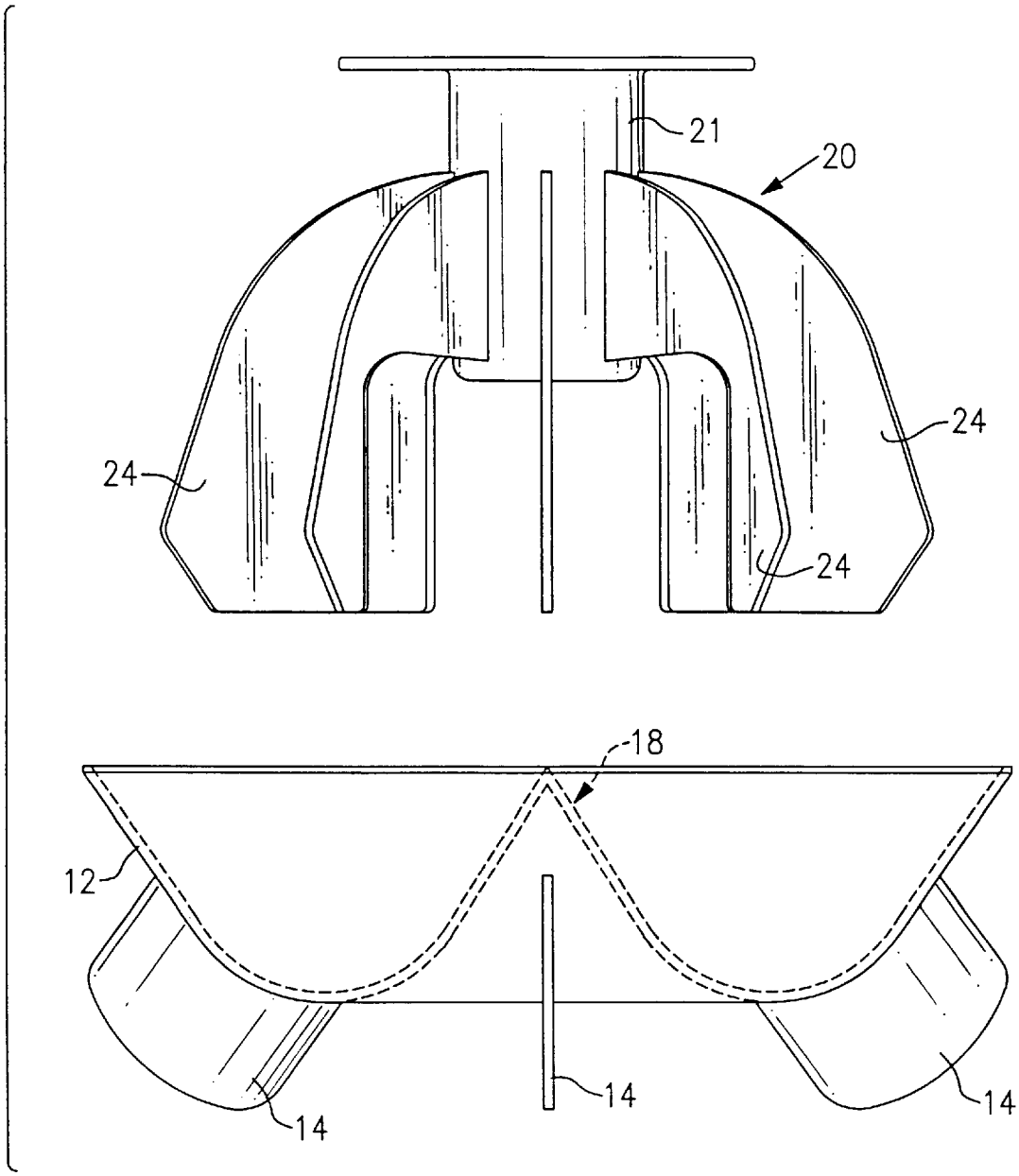
FIG. 2 is a view in perspective of a vane assembly displaced above an inner container of FIG. 1 with an outer container and lid removed from this view.

Referring to both FIG. 1 and on occasion to FIG. 2 is shown, a seed husk separator, identified in general by the reference numeral 10.

An inner container 12 has center a "W" shaped cross section that somewhat resembles an orange juice squeezing bowl. This shape optimally directs an air flow pattern. Creation of the air flow is described in greater detail hereinafter. The inner container 12 includes a plurality of feet 14 that keep it raised when disposed inside of an outer container 16.

The inner container 12 includes a raised center portion 18. A vane assembly, identified in general by the reference numeral 20, is attached to housing 21. The housing 21, in turn, is attached to a lid 22.

The lid 22 functions a cover that snaps over the outer container 16. All is preferably made of a pliable TUPPERWARE™ type of plastic.

The vane assembly 20 includes a plurality of planar vanes 24 that extend out from the housing 21 at one end thereof and continue in a generally downward arc where a second end of each of the vanes 24 abuts against an inside surface of the inner container 12.

The vanes 24 prevent either seeds 25*a* or husks 25*b* from whirling around in the inner container 12. If the vanes 24 were not present a cyclonic effect would occur that would tend to rotate the husks 25*b* in a circle just slightly above the seeds 25*a*. This would be ineffective at displacing the husks 25*b* out from the inner container 12.

The mechanism of displacement of the husks 25*b* from the inner container 12 by the seed husk separator 10 is described in greater detail hereinafter.

A fan 26 is preferably powered by a DC motor 28 that is disposed in a lower end of the housing 21 where it is attached. The housing 21 is attached to the lid 22 by rivets 27 or otherwise, as desired. A battery 30 is attached to a second housing 29 that is also attached to the lid 22.

Operation of the motor 28 is controlled by a switch 32 with, preferably, an LED indicator light 34 to show if the motor 28 is in operation.

Obviously, the motor 28, the switch 32, and the battery 30 are wired in series so as to complete an electrical circuit when the switch 32 is actuated. The LED 34 may also be wired in series or in parallel across the motor 28, as preferred and as are well known in the electronic arts.

An offset mass 35 is attached to the fan 26 and when the motor 28 is turning, introduces vibration to the motor 28. The offset mass 35 could, of course, be attached to a shaft of the motor 28 or elsewhere, as desired. What is important is to introduce vibration to the system (i.e., the seed husk separator 10) when the motor 28 is in operation.

A momentary type of a switch (not shown) may be used for the switch 32 and may be held in a depressed position for as long as it is desirable to actuate the motor 28.

Alternatively, an electric circuit (not shown) may be included with an electronic timer to actuate the motor 28 for a predetermined period of time subsequent to each depression of the momentary switch or toggling of the switch 32.

Such modifications are also well known to those having ordinary skill in the electronic arts and are mentioned to illustrate that, if desired, various versions, some more deluxe than others, of the seed husk separator 10 may be offered for sale.

In use, the seeds 25*a* with the husks 25*b* are placed in the inner container 12. Normally, they are dumped out of a seed dish (not shown) that has been removed from a bird cage (not shown).

The lid 22 is then placed over the outer container 16 and pressed into position so as to allow the second end of each of the vanes 24 to settle against the inside of the inner container 12.

The switch 32 is turned on for a period of time ranging from about 15 seconds to one minute and is then shut off. While the motor 28 is on the offset mass 35 that is attached to the fan 26 vibrates.

The vibration is then transferred through the vanes 24 to the inner container 12 which then also vibrates, in turn. The seeds 25*a* vibrate downward in the inner container 12 while the husks 25*b* tend to rise upward.

The husks 25*b* that rise to the surface are then blown off of the seeds 25*a* and out of the inner container 12. The husks 25*b* pass around the outside edge of the inner container 12 and through a gap 37 that exists around the inner container 12 intermediate the outer container 16.

The husks 25*b* tend to collect under the center of the inner container 12 in a pile 36. The lid 22 is then removed along with the attached vane assembly 20. Predominantly good clean seed 25*a* remains in the inner container 12 and this is again fed to the birds by depositing the seed 25*a* in the seed dish that is placed in the bird cage. If desired, an additional quantity of fresh seed is added to top off the seed dish.

The inner container 12 is removed and the pile 36 of husks 25*b* are thrown out by dumping them into the trash. Accordingly, a fast, easy, non-messy and effective way of separating husks from seeds is provided.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A seed husk separator that is adapted to separate a seed husk apart from seed, comprising:

(a) an outer container;

(b) an inner container, said inner container disposed inside of said outer container and including a lid that covers said outer container during use and wherein said inner container is disposed entirely within said outer container during use and wherein there is no outlet from said outer container during use for either said seed or said seed husk; and (c) means for displacing air proximate said inner container sufficient to urge said seed husk out of said inner container and into said outer container.

2. A seed husk separator that is adapted to separate a seed husk apart from seed, comprising:

(a) an outer container;

(b) an inner container, said inner container disposed inside of said outer container and including a lid that covers said outer container during use and wherein said inner container is disposed entirely within said outer container during use and wherein there is no outlet from said outer container during use for either said seed or said seed husk;

(c) means for displacing air proximate said inner container sufficient to urge said seed husk out of said inner container and into said outer container; and (d) means for vibrating said inner container.

3. The seed husk separator of claim 2 including means for preventing a cyclonic air pattern from occurring proximate said inner container.

4. The seed husk separator of claim 2 wherein said inner container includes a generally "W-shaped" cross-sectional profile that is taken across a centerline thereof.

5. The seed husk separator of claim 2 including a vane assembly that is attached to a housing, and wherein said housing is attached to said lid, and wherein said vane assembly includes a plurality of planar vanes that extend from said housing.

6. The seed husk separator of claim 5 wherein said plurality of vanes contact an inner surface of said inner container when said lid is attached to said outer container.

7. The seed husk separator of claim 6 wherein said means for displacing air includes a motor attached to an end of said housing that is distally disposed with respect to said lid and wherein said motor includes a fan attached thereto.

8. The seed husk separator of claim 7 wherein said fan displaces air toward said inner container and wherein said plurality of vanes are adapted to prevent said cyclonic pattern of air current from occurring.

9. The seed husk separator of claim 7 wherein said means for vibrating said inner container includes an offset mass that vibrates said motor when said motor is energized.

10. The seed husk separator of claim 9 wherein said offset mass is attached to said fan.

11. A seed husk separator that is adapted to separate a seed husk apart from seed, comprising:

(a) an outer container;

(b) an inner container, said inner container disposed inside of said outer container and including a lid that covers said outer container during use and wherein said inner container is disposed entirely within said outer container during use and wherein there is no outlet from said outer container during use for either said seed or said seed husk;

(c) means for displacing air proximate said inner container sufficient to urge said seed husk out of said inner container and into said outer container; and (d) means for preventing a cyclonic pattern of air from occurring proximate said inner container.

12. A method for separating a seed husk apart from seed, comprising:

(a) providing an outer container;

(b) providing an inner container inside of said outer container and a lid that covers said outer container during use and wherein said inner container is disposed entirely within said outer container during use and wherein there is no outlet from said outer container during use for either said seed or said seed husk; and (c) providing means for displacing air proximate said inner container sufficient to urge said seed husk out of said inner container and into said outer container.

* * * * *